United States Patent [19]

Tharman

[11] 4,430,984

[45] Feb. 14, 1984

[54] BRACKET FOR BREAKERLESS IGNITION SYSTEM

[75] Inventor: Paul A. Tharman, Milwaukee, Wis.

[73] Assignee: Briggs & Stratton Corporation, Wauwatosa, Wis.

[21] Appl. No.: 324,143

[22] Filed: Nov. 23, 1981

[51] Int. Cl.[3] ..... F02P 1/00

[52] U.S. Cl. ..... 123/647; 310/70 R; 123/149 R

[58] Field of Search ..... 123/149 R, 149 A, 149 D, 123/647, 601, 599, 595; 310/70 R, 70 A

[56] References Cited

U.S. PATENT DOCUMENTS

| | | | |
|---|---|---|---|
| 3,527,266 | 9/1970 | Santi | 123/149 D |
| 4,170,977 | 10/1979 | Carmichael | 123/599 |
| 4,270,509 | 6/1981 | Tharman | 123/647 |
| 4,288,834 | 9/1981 | Burson | 123/601 |

*Primary Examiner*—Ronald B. Cox

*Attorney, Agent, or Firm*—Andrus, Sceales, Starke & Sawall

[57] ABSTRACT

A bracket for mounting a transistor device and trigger coil of a breakerless ignition system between the induction coil and one of the leg portions of an A-shaped armature core. The bracket includes a hollow housing for receiving the transistor and trigger coil which are secured therein by means of an epoxy potting material. A pair of spaced guide surfaces integrally formed in the housing provide a guideway for slidably receiving the armature leg. A resilient arm member projects from the housing and includes a hooked portion which snaps into a locked position when the bracket is slid onto the armature leg to hold the bracket in place. A pair of resilient, spaced apart wing members also project from the housing to engage the induction coil to prevent vibration of the bracket between the induction coil and armature, and a third resilient wing member projects from one of the guide surfaces to engage the armature leg and prevent vibration of the bracket between the guide surfaces.

18 Claims, 7 Drawing Figures

Fig. 4
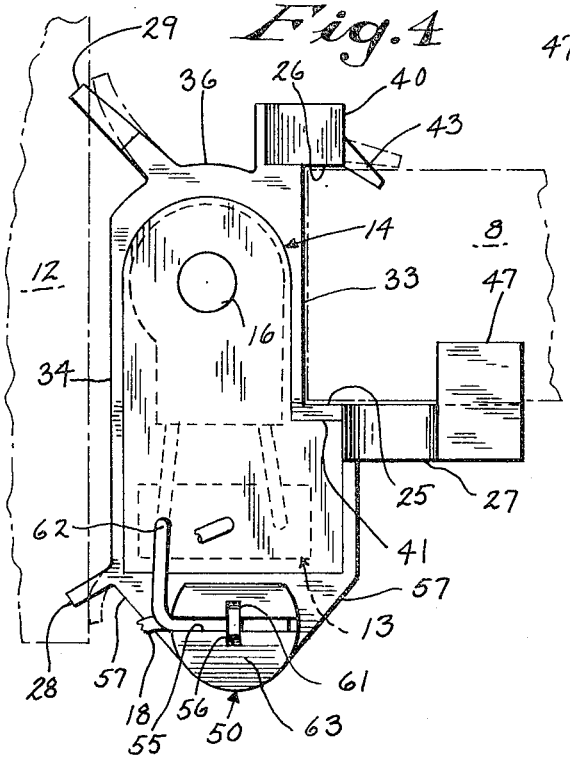
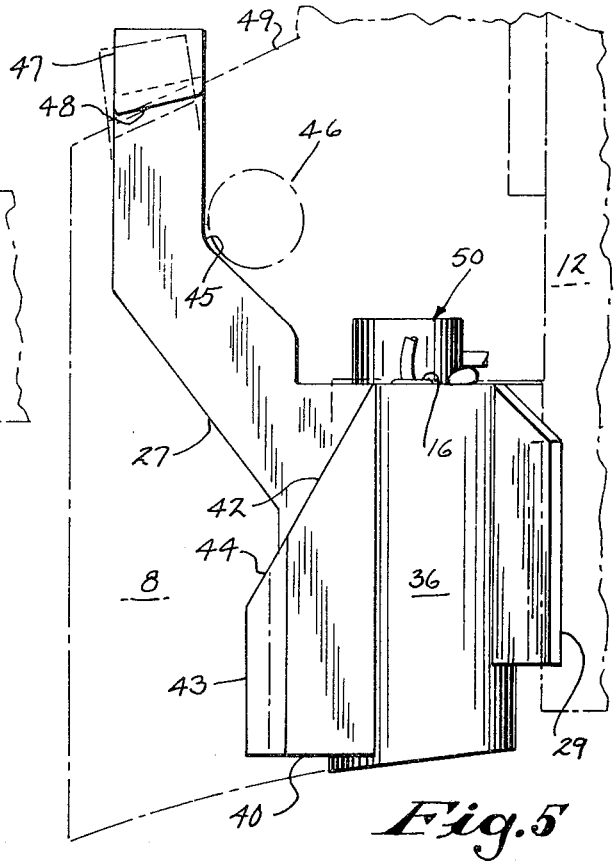
Fig. 5
Fig. 6
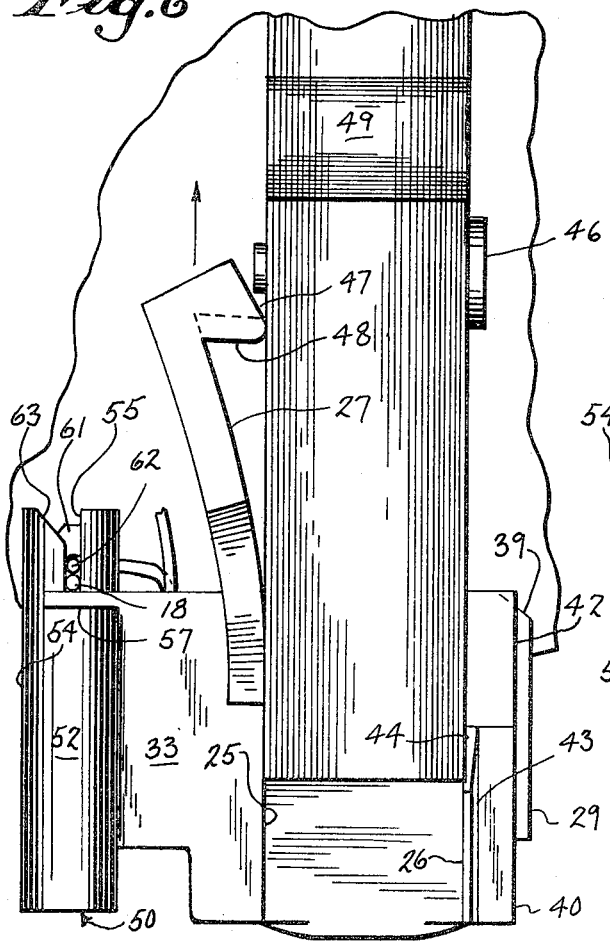
Fig. 7
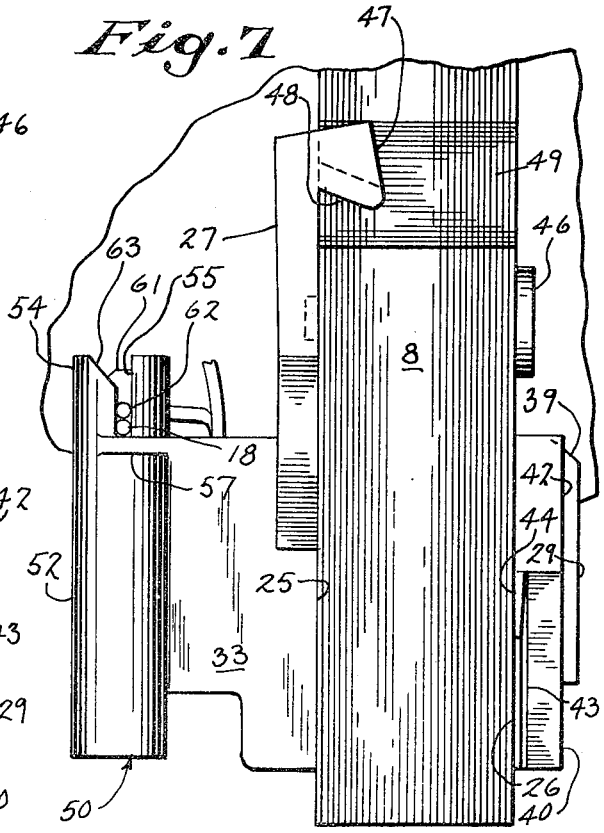

BRACKET FOR BREAKERLESS IGNITION SYSTEM

BACKGROUND OF THE INVENTION

The present invention relates to mounting devices, and more particularly to a bracket for mounting the components of a breakerless ignition system to the leg portion of an armature core.

The conventional ignition system which has been employed with internal combustion engines for many years comprises a primary and a secondary winding that are inductively coupled with one another, a spark plug connected across the terminals of the secondary winding, and switching means for closing a circuit that enables current flow in the primary winding and for opening that circuit at a time in the engine cycle when the spark plug is to be fired. The switching means which has been employed with such ignition systems for many years comprises a pair of hard metal breaker points that are actuated by means of a cam mechanism rotated in timed relation to the engine cycle, and a condenser connected across the points to minimize arcing between them. More recently, however, solic state switching devices are being utilized to replace the conventional condensor and breaker points in ignition systems due to their efficient operation and long service life.

One breakerless ignition system that is particularly advantageous in its application to a magneto ignition system for small engines of the type used for powering lawn mowers, small pumps and electrical generators is shown in Tharman, U.S. Pat. No. 4,270,590 which is assigned to the assignee of the present invention. The breakerless ignition system shown therein has a switching device that includes a transistor for controlling flow of current through the primary winding of an induction coil, and a trigger coil which cooperates with a rotating magnet and with the armature core to provide a source of biasing current for the transistor whereby the transistor is switched on and off in timed relation to the engine cycle at all engine speeds.

It is desirable to mount the transistor and trigger coil of such a breakerless ignition system within the existing spaced limitations of small engines so that redesigning of the engine components is unnecessary. It is also desirable to mount the trigger coil so that it is properly positioned with respect to the rotating magneto magnet, and in such a manner that the wires connecting the transistor, trigger coil and induction coil do not break from vibrational stresses. One such mounting arrangement is shown in the aforementioned Tharman patent and includes an L-shaped bracket fastened in place by means of a screw to a leg portion of the armature core.

SUMMARY OF THE INVENTION

A bracket for mounting a switching means of a breakerless ignition system to a leg portion of an armature core. The bracket includes a housing that defines a chamber for containing the switching device, a pair of spaced guide surfaces formed in one side of the housing which provide a guideway for slidably receiving the leg portion of the armature core, and a resilient arm member projecting from the housing which prevents the bracket from sliding off the armature leg.

The switching means includes a transistor for controlling the flow of current through a primary winding of a magneto armature, and a trigger coil which cooperates with a magnet carried by a rotating engine flywheel and with portions of the magneto armature core to provide a source of biasing current to the transistor so that the transistor is switched on and off in timed relation to the engine cycle to fire a spark plug.

The bracket is preferably molded in one piece of plastic material with the chamber divided into a transistor-receiving pocket and a separate trigger coil-receiving pocket. The transistor and trigger coil components are secured within their respective pockets by means of an epoxy potting material. The epoxy potting material provides an inexpensive and efficient mechanism for maintaining the transistor and trigger coil stationary within the housing, and the plastic housing together with the epoxy material provides a self-contained unit which seals the transistor and trigger coil components from moisture.

The armature core is substantially A-shaped having a pair of leg portions which present a pair of spaced main pole faces that are positioned adjacent the orbit of the rotating magneto magnet and having a crossbar portion which connects between the leg portions and supports a primary winding and a secondary winding in an induction coil. The bracket mounts the transistor and trigger coil between the induction coil and one of the leg portions so that the longitudinal axis of the trigger coil is positioned substantially perpendicular to the axis of rotation of the flywheel. This position provides for a maximized flux density in the trigger coil. This position also enables the transistor and trigger coil to be mounted within the existing spaced limitations of the engine without interfering with any of the other existing components of the engine and without need for any redesigning of engine components.

The resilient arm member has a locking surface formed thereon so that as the housing is slid onto the leg portion of the armature core the arm member is in a flexed position until the arm member snaps into a locked position whereby the locking surface engages an abutment surface on the armature leg portion to prevent the bracket from sliding off the armature.

The bracket also includes a pair of resilient spaced apart wing members projecting from the housing which engage the induction coil and prevent vibration of the bracket between the induction coil and armature leg. A third resilient wing member projects from one of the guide surfaces to engage the armature leg and prevent vibration of the bracket between the guide surfaces. These wing members are utilized to take up the manufacturing tolerances in the magneto armature so that the bracket is provided with a tight fit between the induction coil and armature leg to prevent vibration.

The bracket can be quickly and easily installed on newly manufactured engines as well as on existing engines so that the transistor and trigger coil may be utilized as a replacement for the conventional condenser and breaker points to convert existing engines to ones having a breakerless ignition system.

Other objects and advantages of the invention will appear from the following description.

BRIEF DESCRIPTION OF THE DRAWINGS

The drawings illustrate the best mode presently contemplated of carrying out the invention.

In the drawings:

FIG. 4 is a top view of the bracket assembly shown in FIG. 3 showing the position of the bracket assembly with respect to the armature core and induction coil;

FIG. 5 is a rear view of the bracket assembly shown in FIG. 4;

FIG. 6 is a side view of the bracket assembly showing the resilient arm in a flexed position; and FIG. 7 is a side view of the bracket assembly similar to FIG. 6 showing the resilient arm in a locked position.

DESCRIPTION OF THE PREFERRED EMBODIMENT

Figure 1:
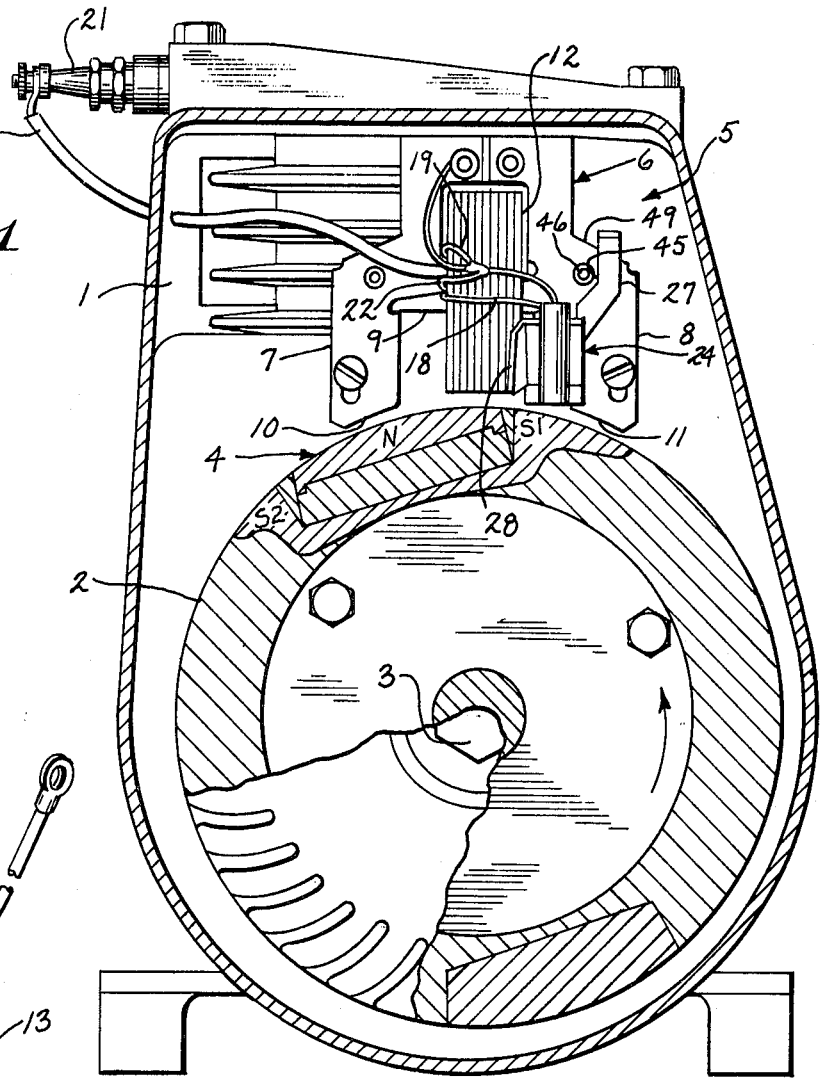
FIG. 1 is a front view in elevation and partially in section of a single cylinder engine having a bracket for mounting the components of a breakerless ignition system in accordance with the principles of the present invention.

Referring now to the drawings, FIGS. 1–7 illustrate a preferred embodiment of the present invention incorporated in a single cylinder engine having a magneto ignition system. Although the present invention is shown and described in relation to a single cylinder engine used in powering lawn mowers, small pumps and electrical generators, it is readily obvious to those skilled in the art that the principles of the present invention are readily adaptable to multi-cylinder engines. Only those portions of the engine that pertain to the ignition system are illustrated, namely, the body 1 of the engine, a flywheel 2 which is mounted on the engine crankshaft 3 to rotate therewith, a permanent magnet assembly 4 carried by the flywheel for orbital motion in timed relation to the engine cycle, and a magneto armature 5 which cooperates with the magnet assembly 4 and is mounted on engine body 1.

The magneto armature 5 is comprised of a generally A-shaped core or lamination 6 having a pair of leg portions 7 and 8, and a cross-bar portion 9 which connects between the leg portions 7 and 8. The legs 7 and 8 of core 6 project toward the orbit of magnet assembly 4, and respectively terminate in main pole faces 10 and 11 that are positioned adjacent the orbit of the rotating magnet assembly 4 so that flux is charged into the core 6 by the magnet assembly 4. The cross-bar portion 9 supports an induction coil 12 which includes a primary winding having a relatively small number of turns of relatively coarse wire and a secondary winding having numerous turns of relatively fine wire.

Figure 2:
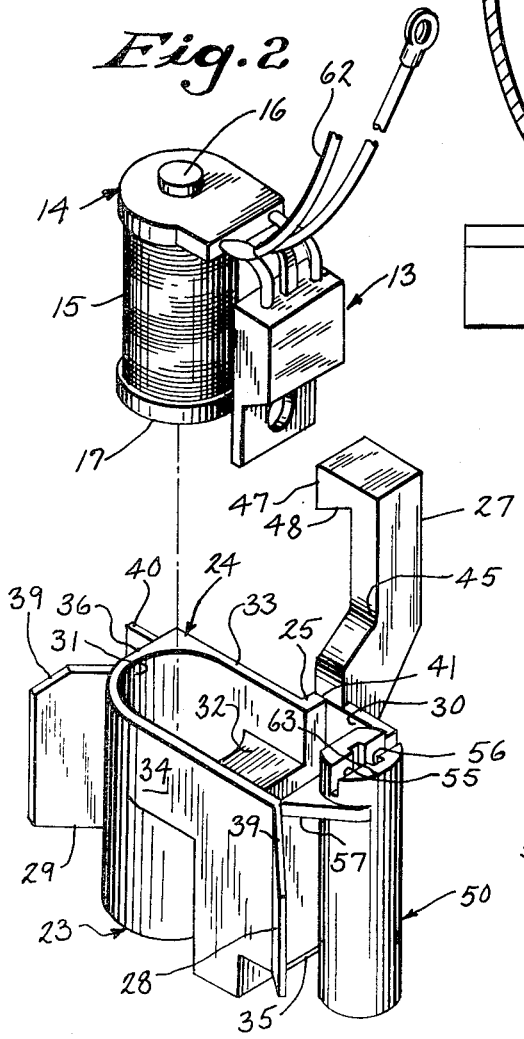
FIG. 2 is an exploded perspective view showing the bracket of the present invention and the trigger coil and transistor components of the breakerless ignition system.

The operation of the magneto armature 5 requires that a circuit between the terminals of the primary winding be closed and opened by a switching means operating in properly timed relation to the engine cycle. Conventionally, this switching means comprised mechanically actuated breaker points that were actuated by a cam mechanism and a condenser that connects across the points to minimize arcing between them. As is shown in FIG. 2, however, the conventional mechanically actuated breaker points and condenser are replaced in the engine shown in FIG. 1 by electronic switching means comprising a transistor device 13 and a small trigger coil 14 that includes a biasing coil 15 wound on a ferromagnetic core 16. The rotating permanent magnet assembly 4 cooperates with the biasing coil 15 and its core 16 to turn on the transistor device 13 at the time in the engine cycle when conventional breaker points would close and to turn off the transistor abruptly at the time when breaker points would open to produce a spark. The core 16 is oriented to extend substantially radially to the orbit of the magnet assembly 4 so that its longitudinal axis is substantially perpendicular to the axis of rotation of flywheel 2. The core 16 has a pole face 17 at its end adjacent to the orbit of magnet assembly 4 through which flux is charged into trigger coil 14 by the magnet assembly 4. For an understanding of how the transistor device 13 and trigger coil 14 function, one should refer to Tharman, U.S. Pat. No. 4,270,509. As shown, one end 18 of the primary winding is connected with the emitter of the transistor device 13 while the other end 19 of the primary winding is connected to ground, and one end 20 of the secondary winding is connected to a spark plug 21 while the other end 22 of the secondary winding is connected to ground.

Referring now to FIGS. 2–7 there is shown a bracket 23 for mounting the transistor device 13 and trigger coil 14 between the armature leg 8 and induction coil 12. The bracket 23 is molded in one piece of a plastic material and comprises a hollow housing 24, a pair of spaced guide surfaces 25 and 26 integrally formed in one side of housing 24, a resilient arm member 27 projecting from housing 24, and a pair of resilient, spaced apart wing members 28 and 29 projecting from the other side of housing 24.

Housing 24 defines a chamber which is divided into a transistor-receiving pocket 30 and a trigger coil-receiving pocket 31 by means of a wall 32. Pocket 30 is substantially rectangular in shape and pocket 31 is substantially cylindrical in shape to generally correspond to the shapes of the transistor device 13 and trigger coil 14. Housing 24 includes a pair of substantially parallel side walls 33 and 34, a top wall 35, a bottom wall 36, and a rear wall 37. The front of housing 24 is open to permit insertion of transistor device 13 and trigger coil 14 into the pockets 30 and 31. Thus, pocket 30 is defined by the upper portions of side walls 33 and 34, top wall 35, dividing wall 32 and the upper portion of rear wall 37, and pocket 31 is defined by the lower portions of said walls 33 and 34, bottom wall 36, dividing wall 32 and the lower portion of rear wall 37. It should be noted that wall 32 extends only about halfway from rear wall 37 to the front of housing 24 so that the chamber within housing 24 is substantially U-shaped. This U-shape permits the transistor device 13 and trigger coil 14 to be connected together prior to assembly in the bracket, as shown in FIG. 2, and then inserted as a single unit entirely within housing 24.

Figure 3:
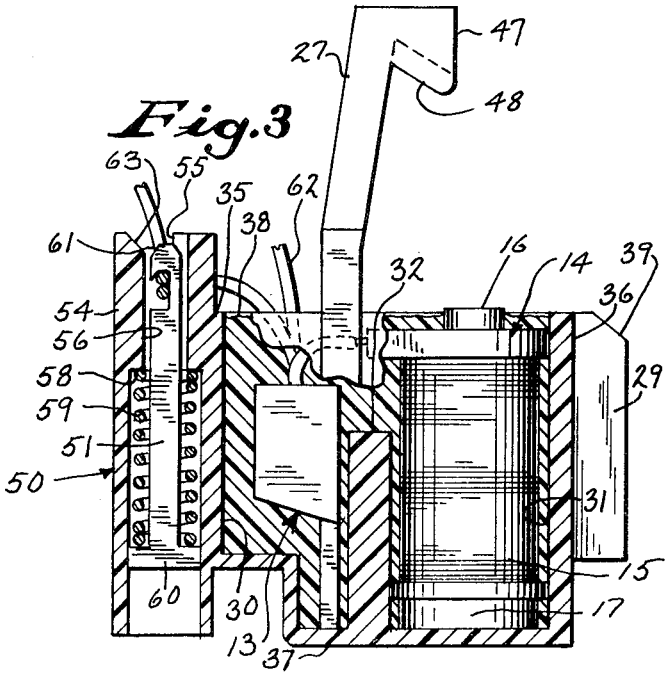
FIG. 3 is a side view partially in section showing the manner of assembling the bracket, trigger coil and transistor.

The switching device comprised of transistor device 13 and trigger coil 14 is secured within housing 24 by means of an epoxy potting material 38. The epoxy potting material 38 completely encapsulates the transistor device 13 and trigger coil 14 so that only the wire leads which interconnect these components with the other components of the ignition system extend from the front of housing 24. Pole face 17 at the end of core 16 which is spaced from the orbit of magnet assembly 4 also projects from the epoxy potting material, as shown in FIG. 3, and when assembled is in contact with armature core or lamination 6 to provide a strong flux path for trigger coil 4, as shown in FIG. 5. The epoxy potting material may be any conventional one component or two component epoxy material which cures in air or upon the application of heat.

Resilient wing members 28 and 29 project divergently with respect to one another from side wall 34 of housing 24. As shown, wing member 28 is located near the top of housing 24 while wing member 29 is located near the bottom of housing 24. Each wing member 28 and 29 has a tapered front edge 39 which permits the wing member 28 and 29 to be easily slid against the side of induction coil 12 when bracket 23 is being assembled on armature leg 8. As seen best in FIG. 4, when bracket 23 is assembled on leg 8, wing member 28 and 29 are deformed in a flexed position and are utilized to take up the manufacturing tolerances in the gap between the induction coil and leg 8 since the dimension of this gap will vary slightly between individual assemblies. Wing members 28 and 29 also provide a mechanism for forcing the side wall 33 between guide surfaces 25 and 26 to bear tightly against the side of armature leg 8 to provide a tight fit for bracket 23 and prevent vibration of housing 24 between the induction coil 12 and armature leg 8, that is, translational vibration.

Guide surface 26 projects substantially perpendicular from side wall 33 of housing 24, and is provided by an integral lip 40 formed along the lower edge of side wall 33. Guide surface 25 also projects substantially perpendicular from side wall 33 and is provided by an integral shoulder portion 41 near the upper end of side wall 33. Guide surface 25 is substantially parallel to guide surface 26 and together surfaces 25 and 26 form a guideway for slidably receiving the leg portion 8 of armature core 6. As shown best in FIG. 5, the front edge of lip 40 is tapered as at 42 to enable the leg portion 8 to be easily guided between surfaces 25 and 26 as bracket 23 is slid along the inside edge of leg 8 during assembly.

As shown best in FIG. 4, a third resilient wing member 43 projects inwardly from guide surface 26 toward guide surface 25 at an oblique angle with respect to surface 26. When wing member 43 engages the rear face of armature leg 8 it is deformed into a flexed position to force guide surface 25 to bear tightly against the opposite face or front face of armature leg 8 to prevent vibration of the housing 24 between the surfaces 25 and 26. It should be noted that the front edge 44 of wing member 43 is also tapered to enable the armature leg 8 to be easily guided between surfaces 25 and 26.

As shown, resilient arm member 27 is integrally formed on housing 24 and projects forwardly from side wall 33 in a cantilevered fashion. As shown best in FIGS. 1 and 5, arm 27 is notched as at 45 so that the end of rivet 46, which is one of the rivets used to hold the individual plates of the armature core or lamination 6 together, will not interfere with the arm 27 as it is slid along the front face of armature leg 8. As shown best in FIG. 3, arm member 27 projects outwardly at a slightly downwardly inclined angle and terminates at its free end with a downwardly projecting hook portion 47 which includes a locking surface 48 formed therein. As seen in FIG. 3, locking surface 48 projects rearwardly and away from the bottom surface of arm member 27, and as seen in FIG. 5, locking surface 48 tapers downwardly at an inclined angle from the right side to the left side of arm member 27. Locking surface 48 substantially corresponds to the configuration of an abutment surface 49 formed along the side edge of armature leg 8. Thus, as bracket 23 is slid onto armature leg 8, arm member 7 is in a flexed position as shown in FIG. 6 until its hooked portion 47 passes the side edge of leg 8 so that arm member 27 snaps into a locked position, shown in FIG. 7, whereby the locking surface 48 engages the abutment surface 49 on leg portion 8 to prevent the bracket 23 from sliding off armature leg 8.

A hollow tubular-shaped portion 50 projects from top wall 35, and houses a spring-loaded fastening member 51. The tubular portion 50 includes a hollow rear portion 52 defining a cylindrical bore 53, and a forward portion 54 having a pair of transverse slots 55 and 56 formed therein. Tubular portion 50 is integrally attached to top wall 35, and is reinforced at its forward end by means of a pair of struts 57 projecting upwardly from top wall 35. Tubular portion 50 is molded of a plastic material in one piece with the other components of housing 24. Slot 55 extends across the entire diameter of tubular portion 50, and has a depth extending from the front face of tubular portion 50 to the struts 57. Slot 56 extends crosswise or normal to slot 55 and extends from the front face of tubular portion 50 through the forward portion 54 and into bore 53. As seen in FIG. 3, bore 53 is wider than slot 56, and thus an annular shoulder 58 is formed within tubular portion 50 at the forward end of bore 53. Shoulder 58 provides a seat for the forward end of a spring 59 which encircles the shaft of fastening member 51. Fastening member 51 includes a T-shaped rear end 60 which has the rearward end of spring 59 seated against its cross-bar portion, and a hook-shaped forward end 61. The forward end 61 of member 51 is thus urged rearwardly by the force of spring 59, and securely holds the primary wire 18 and wire 62 connected to the emitter of the transistor device 13 within slot 55, as shown in FIGS. 4 and 6. Fastening member 51 thus isolates wires 18 and 62 from excessive vibration. An inclined surface 63 is formed along the front face of tubular portion 50 to aid in the easy insertion of wires 18 and 62 into slot 55.

Various modes of carrying out the invention are contemplated as being within the scope of the following claims particularly pointing out and distinctly claiming the subject matter which is regarded as the invention.

I claim:

1. A bracket for mounting a switching means of a breakerless ignition system to a leg portion of an armature core that supports an induction coil, comprising:

a housing that defines a chamber for containing the switching means;

a pair of spaced guide surfaces projecting from one side of said housing which form a guideway for slidably receiving the leg portion of said armature core;

resilient means projecting from said housing to engage said induction coil to prevent vibration of said housing between said coil and core; and a resilient arm member projecting from said housing having a locking surface formed thereon so that as said housing is slid onto said leg portion the arm member is in a flexed position until said arm member snaps into a locked position whereby said locking surface engages an abutment surface on said leg portion.

2. In combination, an ignition system that includes a substantially A-shaped armature core having a pair of leg portions which present a pair of spaced main pole faces that are positioned adjacent the orbit of a magnet carried by a rotating engine flywheel and having a cross-bar portion which connects between said leg portions and supports a primary winding and a secondary winding in an induction coil, a switching means for controlling current flow through the induction coil which includes a transistor device and a trigger coil for biasing the transistor device in timed relation to the engine cycle to fire a spark plug, and a bracket for mounting said switching means between said induction coil and one of said leg portions comprising:

a housing that defines a chamber having a transistor-receiving pocket and a trigger coil-receiving pocket for containing the transistor and trigger coil respectively;

a pair of spaced guide surfaces projecting from one side of said housing which form a guideway for slidably receiving the leg portion of said armature core;

a pair of resilient, spaced apart wing members projecting from said housing on the opposite side from that of said one side to engage said induction coil and force said one side to bear tightly against said armature leg portion to prevent vibration of said housing between said induction coil and said one armature leg portion; and a resilient arm member projecting from said housing in cantilevered fashion having a locking surface formed at its free end so that as said housing is slid onto said leg portion the arm member is in a flexed position until said arm member snaps into a locked position whereby said locking surface engages an abutment surface on said leg portion.

3. In a breakerless ignition system having an armature core which supports a primary winding and a secondary winding in an induction coil and which includes a pair of leg portions which present a pair of spaced main pole faces that are positioned adjacent the orbit of a magnet carried by a rotating portion of an engine, and having a switching means for controlling current flow through the induction coil to fire a spark plug in timed relation to the engine cycle, a bracket for mounting the switching means between the induction coil and one of the leg portions comprising:

a housing that defines a chamber for containing the switching means;

first vibration prevention means projecting from said housing and resiliently engaging said induction coil to prevent translational vibration of said housing between said induction coil and said one armature leg portion;

second vibration prevention means projecting from said housing to prevent vibration of said housing in a direction substantially perpendicular to said translational vibration; and a resilient arm member projecting from said housing having a locking surface formed thereon so that as said housing is positioned between said induction coil and said one armature leg portion the arm member is initially in a flexed position until said arm member snaps into a locked position whereby said locking surface engages an abutment surface on said armature core.

4. In a breakerless ignition system having an armature core which supports a primary winding and a secondary winding in an induction coil and which includes a pair of leg portions which present a pair of spaced main pole faces that are positioned adjacent the orbit of a magnet carried by a rotating portion of an engine, and having a switching means for controlling current flow through the induction coil to fire a spark plug in timed relation to the engine cycle, a bracket for mounting the switching means between the induction coil and one of the leg portions comprising:

a housing that defines a chamber for containing the switching means;

first vibration prevention means projecting from said housing to prevent translational vibration of said housing between said induction coil and said one armature leg portion, said first vibration prevention means includes a pair of resilient, spaced apart wing members projecting from one side of said housing which engage said induction coil and force the opposite side of said housing to bear tightly against said one leg portion;

second vibration prevention means projecting from said housing to prevent vibration of said housing in a direction substantially perpendicular to said translational vibration; and a resilient arm member projecting from said housing having a locking surface formed thereon so that as said housing is positioned between said induction coil and said one armature leg portion the arm member is initially in a flexed position until said arm member snaps into a locked position whereby said locking surface engages an abutment surface on said armature core.

5. A bracket for mounting a switching means of a breakerless ignition system to a leg portion of an armature core, comprising:

a housing that defines a chamber for containing the switching means, said switching means includes a transistor device and a trigger coil, and said chamber is divided into a transistor-receiving pocket and a trigger coil-receiving pocket;

a pair of spaced guide surfaces projecting from one side of said housing which form a guideway for slidably receiving the leg portion of said armature core; and a resilient arm member projecting from said housing having a locking surface formed thereon so that as said housing is slid onto said leg portion the arm member is in a flexed position until said arm member snaps into a locked position whereby said locking surface engages an abutment surface on said leg portion.

6. A bracket for mounting a switching means of a breakerless ignition system to a leg portion of an armature core, comprising:

a housing that defines a chamber for containing the switching means;

a pair of spaced guide surfaces projecting from one side of said housing which form a guideway for slidably receiving the leg portion of said armature core;

said armature core is substantially A-shaped having a pair of leg portions and a cross-bar portion which connects between said leg portions and supports an induction coil, and said switching means is mounted between one of said leg portions and said induction coil;

a pair of resilient, spaced apart wing members projecting from said housing on the opposite side from that of said one side to engage said induction coil and force said one side to bear tightly against said leg portion to prevent vibration of said housing between said induction coil and armature; and a resilient arm member projecting from said housing having a locking surface formed thereon so that as said housing is slid onto said leg portion the arm member is in a flexed position until said arm member snaps into a locked position whereby said locking surface engages an abutment surface on said leg portion.

7. The bracket of claim 4, wherein said second vibration prevention means includes a pair of spaced guide surfaces projecting from one side of said housing which form a guideway for slidably receiving said one leg portion, and a resilient wing member projecting inwardly from one of said guide surfaces to engage said one leg portion and force the other of said guide surfaces to bear tightly against said one leg portion.

8. The bracket of claim 1, wherein said guide surfaces are parallel to one another.

9. The bracket of claim 1, wherein said switching means is secured within said chamber by means of an epoxy potting material.

10. The bracket of claim 1, wherein the armature core is substantially A-shaped having a pair of leg portions and a cross-bar portion which connects between said leg portion and supports said induction coil, and said switching means is mounted between one of said leg portions and said induction coil.

11. The bracket of claim 1, wherein said ignition system further includes a magnet carried by a rotating engine flywheel, and said switching means includes a trigger coil positioned with its longitudinal axis substantially perpendicular to the axis of rotation of said flywheel.

12. The bracket of claim 5, wherein said transistor-receiving pocket is rectangular shaped and said trigger coil-receiving pocket is cylindrical shaped.

13. The bracket of claim 6, wherein said wing members project divergently from said housing with respect to one another.

14. The bracket of claim 1, further including a resilient wing member projecting from one of said guide surfaces to engage said leg portion and force the other of said guide surfaces to bear tightly against the leg portion to prevent vibration of said housing between said guide surfaces.

15. The combination of claim 2, further including a third resilient wing member projecting from one of said guide surfaces to engage said leg portion and force the other of said guide surfaces to bear tightly against the leg portion and prevent vibration of said housing between said guide surfaces.

16. The combination of claim 2, wherein said trigger coil includes a biasing coil wound around a ferromagnetic core, said core providing a pole face that is positioned adjacent the orbit of said magnet and immediately alongside one of said main pole faces.

17. The bracket of claim 3, wherein said first vibration prevention means includes a pair of resilient, spaced apart wing members projecting from one side of said housing which engage said induction coil and force the opposite side of said housing to bear tightly against said one leg portion.

18. The bracket of claim 3, wherein said second vibration prevention means includes a pair of spaced guide surfaces projecting from one side of said housing which form a guideway for slidably receiving said one leg portion, and a resilient wing member projecting inwardly from one of said guide surfaces to engage said one leg portion and force the other of said guide surfaces to bear tightly against said one leg portion.

* * * * *